US009469893B2

(12) United States Patent
Han et al.

(10) Patent No.: US 9,469,893 B2
(45) Date of Patent: Oct. 18, 2016

(54) AGE-HARDENING PROCESS FEATURING ANOMALOUS AGING TIME

(71) Applicants: Ke Han, Tallahassee, FL (US); Pingli Mao, Shenyang (CN); Yan Xin, Tallahassee, FL (US)

(72) Inventors: Ke Han, Tallahassee, FL (US); Pingli Mao, Shenyang (CN); Yan Xin, Tallahassee, FL (US)

(73) Assignee: The Florida State University Research Foundation, Inc., Tallahassee, FL (US)

( * ) Notice: Subject to any disclaimer, the term of this patent is extended or adjusted under 35 U.S.C. 154(b) by 685 days.

(21) Appl. No.: 13/903,501

(22) Filed: May 28, 2013

(65) Prior Publication Data

US 2014/0352853 A1 Dec. 4, 2014

Related U.S. Application Data

(63) Continuation-in-part of application No. 12/838,004, filed on Jul. 16, 2010, now abandoned.

(51) Int. Cl.
*C22F 1/10* (2006.01)

(52) U.S. Cl.
CPC ..... *C22F 1/10* (2013.01)

(58) Field of Classification Search
CPC ..... C22F 1/10; C22C 19/051; C22C 19/052; C22C 19/053; C22C 19/055; C22C 19/056; C22C 19/057
See application file for complete search history.

(56) References Cited

U.S. PATENT DOCUMENTS 6,177,046 B1 * 1/2001 Simkovich ..... C22C 19/03 148/427

OTHER PUBLICATIONS

H.M. Tawancy, "Comparative corrosion behavior of Ni—Mo and Ni—Mo—Cr alloy for applications in reducing environments," Journal of Materials Science, 41, 2006, pp. 8359-8362.*

Pingli Mao, Yan Xin, Ke Han, and Weiguo Jiang, "Effects of heat treatment and Re-content on the TCP-phase in two Ni—Mo—Cr—Re superalloys," Acta Metallurgica Sinica (English Letters), vol. 22, No. 5, Oct. 2009, pp. 365-372.*

* cited by examiner

*Primary Examiner* — Scott Kastler
*Assistant Examiner* — Vanessa Luk
(74) *Attorney, Agent, or Firm* — J. Wiley Horton

(57) ABSTRACT

This document describes a process/strategy for age hardening nickel based alloys to create desirable properties with reduced energy expenditure. The inventive process introduces isolated atom nucleation sites to accelerate the nucleation rate by approximately 36 times, thereby permitting age hardening to occur in significantly less time and with significantly less energy expenditure.

11 Claims, 3 Drawing Sheets

AGE-HARDENING PROCESS FEATURING ANOMALOUS AGING TIME

CROSS-REFERENCES TO RELATED APPLICATIONS

This application is a continuation-in-part of U.S. patent application Ser. No. 12/838,004. The parent application listed the same named inventors.

STATEMENT REGARDING FEDERALLY SPONSORED RESEARCH OR DEVELOPMENT

This invention was developed at the National High Magnetic Field Laboratory in Tallahassee, Fla. The research has been funded in part by National Science Foundation Contract No. DMR-0654118.

MICROFICHE APPENDIX

Not Applicable

BACKGROUND OF THE INVENTION

1. Field of the Invention

This invention relates to the field of metallurgy. More specifically, the invention comprises a method for achieving accelerated age hardening in superalloys made of nickel, chromium, and molybdenum by the addition of rhenium. The invention allows a greatly accelerated age-hardening process, while substantially reducing the risk of over-aging.

2. Description of the Related Art

Age hardening (also known as "precipitation hardening") is used to produce various alloys with desirable properties. The process is used to mechanically strengthen malleable materials for structural applications. In addition to steels, precipitation hardening is commonly used for aluminum, titanium, and nickel alloys. The process produces fine particles of impurity phases, which act as barriers to the motion of crystallographic lattice dislocations.

Precipitation in solids can produce many different sizes of particles, which have radically different strengthening effects as demonstrated by the following equation:

$$\Delta\sigma=2/(\pi E)^{-1/2}(\lambda_{apb}/b)^{3/2}r^{1/2}f^{1/2}$$

where E is the Young's modulus, $\lambda_{apb}$ is the anti-phase interfacial energy, b is the Burger's vector, r is the size of the precipitates, and f is the volume fraction. Both r and f can be related to l, the distance between the precipitates. If the volume fraction is held constant, then one observes an optimized value for the size of the precipitates (r) at which the material reaches a maximum strength.

The optimal size of the precipitates formed depends upon the thermo-mechanical history of the alloy being hardened. In the prior art, alloys must be kept at elevated temperature for several hours to allow precipitation to take place. Thus, conventional precipitation hardening requires a substantial amount of energy (The large amount of time required is why the process is also referred to as "age hardening").

On the other hand, if the process and alloys are altered so that the precipitates can form in a relatively short period of time, the temporal window for achieving an optimal result usually becomes very narrow. It is then easy to "over-age" the alloy. When a material is over-aged (held at the elevated temperature for too long), then both the size of the precipitates and the distance between the precipitates become too large and the Orowan process operates. At certain values for l and for r, the strength or hardness drops significantly to a value governed by a rule-of-mixture.

An example of a prior art nickel alloy that can be age hardened quickly is IN738LC. This is a nickel based alloy that can be age-hardened in less than 5 minutes at 850° C. Optimum hardness is obtained in about 80 seconds. On the other hand, the hardness will be substantially reduced if the process is carried forward for an additional 40 seconds. In fact, the window of effective age-hardening for this alloy is only about 60 seconds.

One may generally state that the prior art discloses: (1) nickel alloys that can be age-hardened using a process that takes several hours and that are not very sensitive to over-aging (extending the process for an additional 10 hours or more does not significantly reduce the hardness), and (2) nickel alloys that have been altered to age harden very quickly, but which are very sensitive to over-aging (suffering reduced hardness if the aging window is inadvertently extended by as little as 40 seconds). A more useful nickel alloy would be one which (1) age hardens quickly, and (2) is not very sensitive to over aging.

The prior art also discloses accelerating the formation of precipitates in age-hardening by deforming the materials in order to increase the dislocation densities (which enhances the diffusion along the dislocation). In selected alloys, it is in tact essential to deform the alloy before the age-hardening process is applied. Unfortunately, deformation processes are also energy-intensive and therefore expensive. This approach does not represent the desired overall reduction in the amount of energy required for hardening.

The present invention uses a master alloy of nickel, molybdenum, and chromium (Ni—Mo—Cr). The inventors have discovered that the addition of rhenium to this master alloy in the right ratios and under the right conditions produces an unexpected and highly advantageous alteration in the alloy's age-hardening properties. As explained in detail in the descriptive sections to follow, the hardening properties found in the inventive composition and process result from the formation of long-range-ordered ("LRO") precipitates of $Ni_2$(Mo, Cr, Re). The prior art discloses various combinations of the elements, but fails to disclose or suggest the inventive process.

For example, U.S. Pat. No. 4,119,458 to Moore teaches alloys of nickel, chromium, and rhenium. Molybdenum is also disclosed in Moore, though the implied percentage of molybdenum is less than 8% by weight. The master alloy in Moore contains nickel, aluminum, vanadium, and cobalt. The Moore invention is directed to solving the problem of reaction between the molten metal and the crucible surrounding it during a re-melting process in order to form a regular secondary eutectic reaction. Moore does not teach age-hardening and in fact the compositions disclosed in Moore are not able to achieve the performance of the present invention since they do not contain enough Mo-like elements to form $Ni_2$Mo-ordered precipitates.

Another example from the prior art is the article "Comparative Corrosion Behavior of Ni—Mo and Ni—Mo—Cr Alloy for Applications in Reducing Environments," published in the Journal of Material Science, 2006, 41, 8359-8362 (written by Tawancy). The Tawancy article teaches the addition of chromium to enhance corrosion resistance by the delay of $Ni_4$Mo precipitates. It does not suggest the inventive formulation or process related to age-hardening.

In summary, the prior art fails to disclose a Ni—Mo—Cr alloy that can be age-hardened rapidly while displaying resistance to over-aging. The present invention provides a precipitation hardening process which can be completed more rapidly than the known prior art, and which has a relatively broad time window for optimal results. The present invention achieves these results without requiring the use of mechanical deformation.

BRIEF SUMMARY OF THE INVENTION

The present invention comprises a process or strategy for age hardening nickel based alloys to create desirable properties. The inventive process introduces isolated atom nucleation sites to accelerate the nucleation rate by approximately 36 times, thereby permitting age hardening to occur in significantly less time and with significantly less energy expenditure. Further, the inventive process provides a very broad time window for the optimum result, reducing the risk of over-aging.

The inventive composition adds rhenium to a master alloy of Ni—Mo—Cr. By using a suitable fraction for each constituent, along with a suitable age-hardening process, the invention forms long-range-ordered $Ni_2$(Mo, Cr, Re) precipitates and thereby produces a dramatic increase in the age hardening rate without a corresponding reduction in the breadth of the age hardening window.

DETAILED DESCRIPTION OF THE INVENTION

Figure 1:
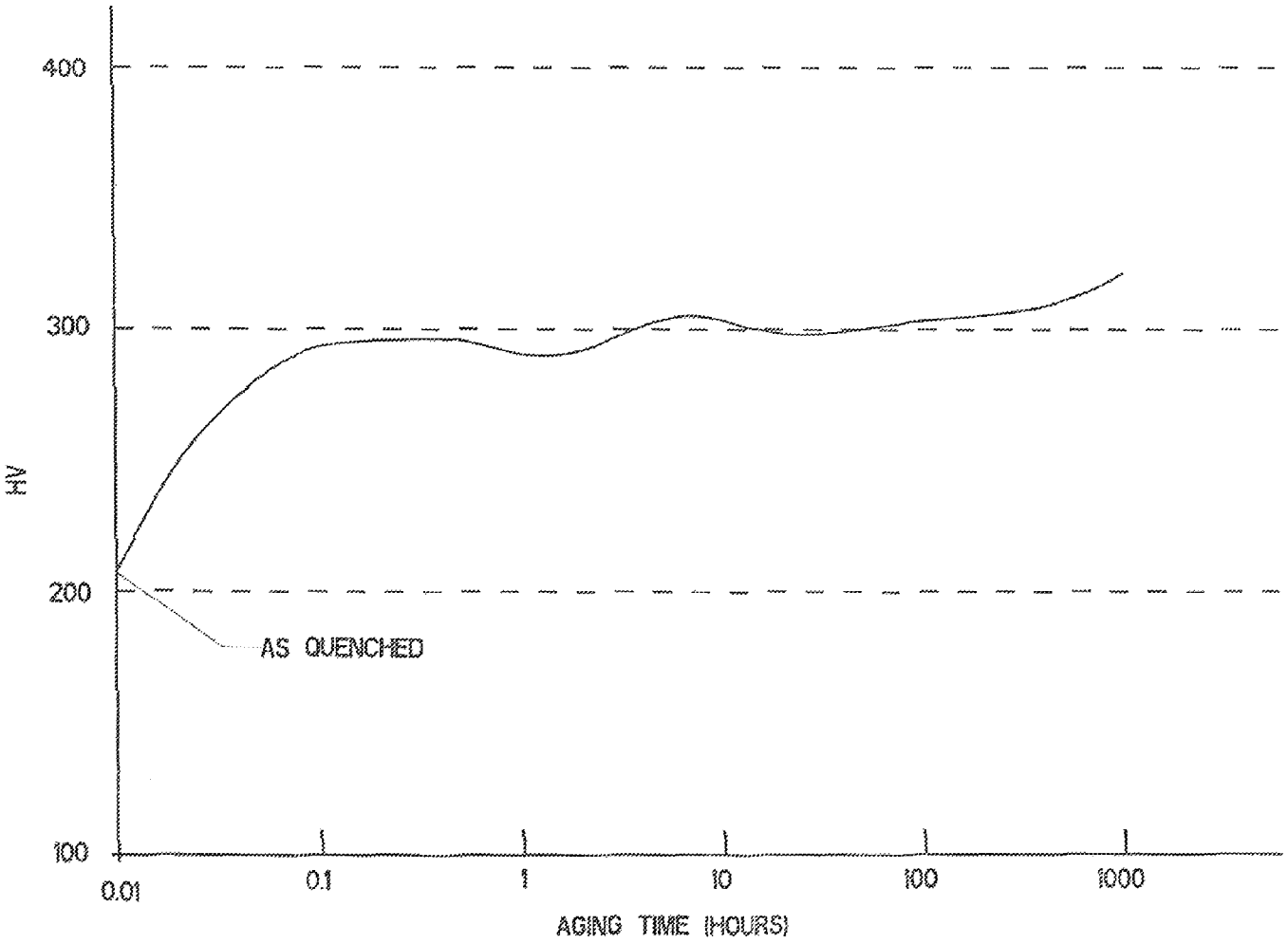
FIG. 1 is a plot of hardness versus aging time at a temperature of 873 K.

The present invention uses alloys made of Cr—Ni—Mo—Re, which are formulated to allow a very different age hardening process from the prior art alloys. The alloys thus formulated can be age hardened in as little as 5 minutes. The same alloy shows stable mechanical properties without over-aging even after a prolonged aging period (up to 500 hours). Thus, the "window" of optimal time for age hardening is quite broad.

The new allow was based on a Ni—Mo—Cr alloy, to which rhenium was added. The Ni—Mo—Cr alloy has a face centered cubic structure above about 1123 K with short-range-ordered (SRO) domains. Long-range-ordered (LRO) domains of $A_2B$ form below 1123 K after a prolonged aging time. The alloys are strengthened by aging when LRO precipitates form. The formation of LRO is beneficial to the alloy's mechanical properties.

The prior art approach to accelerating age hardening uses cold deformation before the heating process. When a sample of Ni—Mo—Cr is 40% cold worked and then heated to 923 K, 2 hours of hardening time is required to provide a strength equivalent to prior art samples aged to 24 hours. Although the cold work is effective in shortening the aging time by a factor of 12, it is still desirable to shorten the time even further to reduce the cost. In addition, cold deformation complicates the fabrication procedure and may embrittle the materials by inducing the $A_3B$ type phase.

Other researchers have tried to accelerate the age hardening process by adding more Mo elements or reducing Cr content. However, over-aging, which is partially due to a formation of stable, but brittle $Ni_3Mo$ phase, is more likely in such a Ni based alloy if the Cr content is too low or the Mo content is too high. Low Cr content also reduces the corrosion resistance of the materials.

Although a Ni—Cr—Mo alloy has excellent properties, one would expect it to have a shorter aging time, higher strength, and greater stability at high temperature without formation of phases that embrittle the material. The inventors ultimately decided to add rhenium (Re) to the prior art, allowing approximately the following percentages by weight: Mo:20-30%, Cr:5-10%, Re:3-10%, Ni:60-70%.

Unlike the prior art, the percentage of Mo in the present invention must be equal to or greater that 20% by weight. This Mo fraction is needed to ensure the formation of $A_2B$ precipitates. Rhenium was selected as an effective alloy element for several reasons. First, rhenium was used to promote formation of a regular eutectic product in Ni alloys. Exemplary alloys include the following (all by weight):

TABLE ONE

| Ni | Re | Co | Cr | W | Al | V | Ta | C |
|---|---|---|---|---|---|---|---|---|
| 64.5 | 6.7 | 4 | 3.95 | 3.2 | 5.5 | 5.55 | 6.5 | 0.29 |
| 63.62 | 6.2 | 3.3 | 4.4 | 3.2 | 5.3 | 5.4 | 9.1 | 0.48 |

In the present invention, the percentage of molybdenum is quite important and it cannot be less than 20% by weight.

In the inventive formulations, rhenium was selected because it has a relatively large atomic diameter (0.27 nm), a high melting point (3459 K), a high modulus of elasticity (329 GPa) and a large negative energy for formation of $A_2B$ type of precipitates by combination of rhenium with Ni and Mo. The large atomic diameter and high melting point elements diffuse relatively slowly so that the kinetics of the precipitate growth will be sluggish and the alloy can be used for long periods without over-aging. The high modulus enhances the strength of the alloy. The large negative energy assists formation of $A_2B$ precipitates (in particular $Ni_2$(Mo, Cr, Re)). When the rhenium participates in the precipitation process, the large atomic diameter also results in more distortion in the lattice of the matrix and accelerates the nucleation of the precipitates.

Our experimental results demonstrate that the addition of rhenium increases the Young's modulus and storage modulus by 10-20% and enhances the stability of the materials during aging. At the same time, the Re accelerates the LRO precipitation hardening by almost 36 times. The magnitude of the acceleration in the LRO precipitation process was quite surprising. FIG. 1 shows a plot of hardness versus the length of aging (note that the X-axis is logarithmic). The hardness of a sample annealed at 1473 K is about 200 HV (1 HV=1 $Kg/mm^2$=9.8 MPa). Aging at 873 K for 1 minute increases hardness by 25%. In the selected area diffraction patterns, samples aged at 873 K for 1 minute show both the diffused SRO and LRO ($A_2B$ type) diffraction spots. However, the intensity of the LRO reflections is much stronger than SRO, indicating that the volume fractions of the LRO domains are larger than the SRO ones.

Figure 2:
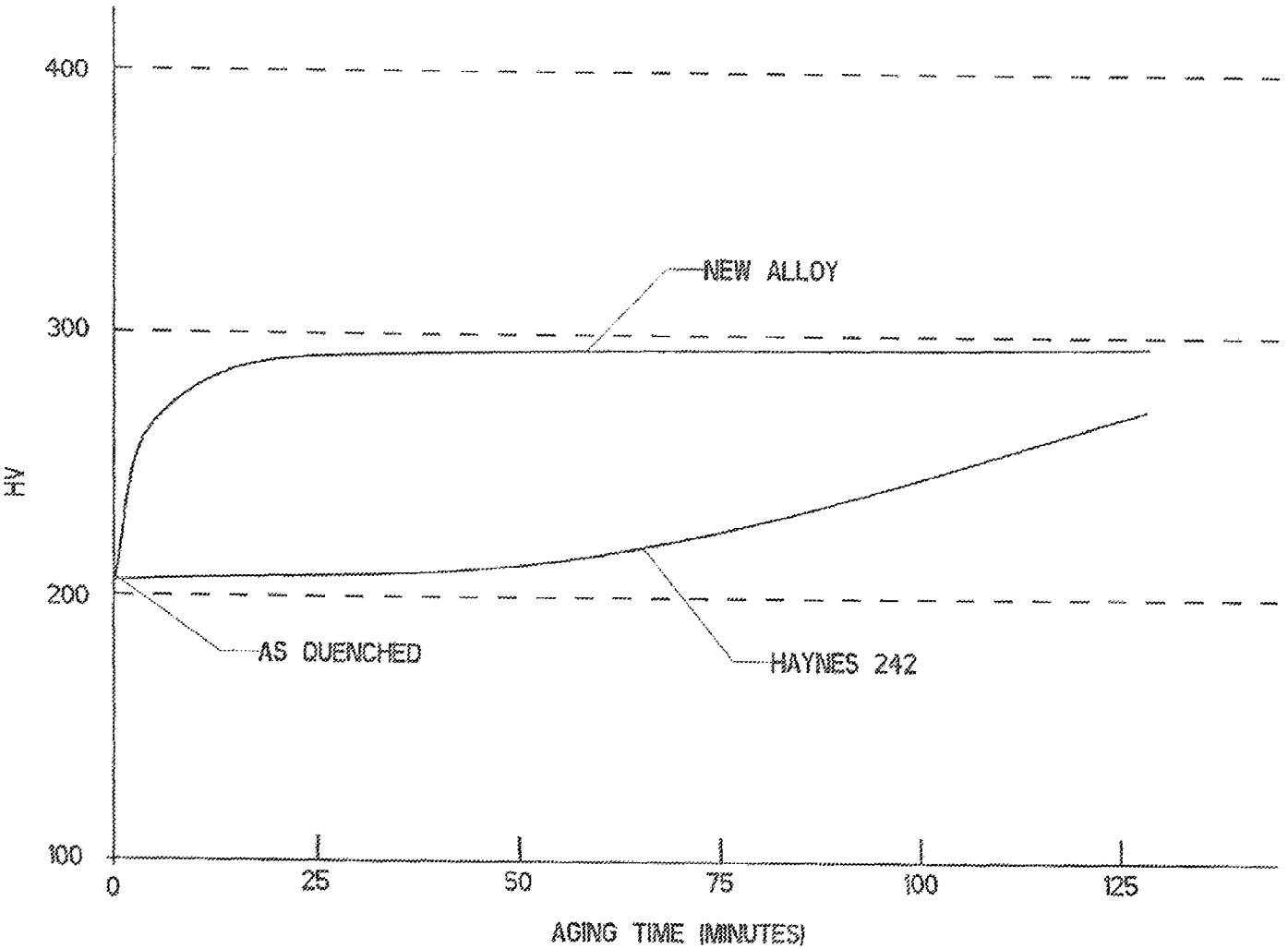
FIG. 2 is a plot of hardness versus aging time at a temperature of 923 K, comparing one of the inventive alloys to a prior art alloy.

FIG. 2 shows a comparison of age hardening of the new alloy versus age hardening of a prior art material which is typically subjected to age hardening (such as HAYNES 242, which is a well-known Ni—Mo—Cr alloy). The reader will observe the dramatic reduction in aging time for the rhenium-containing alloy.

For the new alloy, the $A_2B$ type LRO domain sizes appear to be about 1-5 nm for materials aged at 873 K (600 degrees Celsius) for 4 minute, as shown in FIG. 4. These domain sizes in the inventive materials are about 5 crystallographic unit cell sizes when one views the sample in the −[001] orientation of the matrix. Therefore, the addition of rhenium reduces the age-hardening time by acceleration of the $A_2B$ type LRO precipitate formations with initial size, r, of a few nanometers, where A is Ni and/or Re and B is Mo and/or Re. The beneficial effect of the rhenium addition could be explained by the location of the Re in the materials under the following possibilities: (i) Re accelerates the precipitation by formation of $(Ni,Re)_2Mo$; (ii) Re accelerates the formation of the $Ni_2Mo$ precipitates which exist in its absence but Re will not occupy any sites in the precipitates; (iii) the Re, combining with Ni and Mo, forms nuclei of $Ni_2(Mo,Re)$, where the addition of Re merely increases the supersaturation of the solute atoms for formation of the LRO precipitate of $Ni_2(Mo,Re)$; (iv) the Re, combining with Ni and Mo, forms nuclei of $Ni_2(Mo_nRe_m)$, where the addition of Re not only increases the supersaturation of the solute atoms for formation of the LRO precipitate but also occupies an ordered position in B sites of $A_2B$ type precipitates; or (v) Re and Ni form ordered clusters acting as nucleation site for $Ni_2(Mo, Re)$ nucleations, i.e., Re forms nuclei of precipitates at an earlier stage than would occur in its absence. To elucidate the impact of Re, i.e., how the Re atoms accelerate the aging we closely examined the atomistic structures of the materials in Z-contrast images in combination with our calculations.

Our Z-contract imagines demonstrate that Re atoms occupy the site B in the $A_2B$ precipitates. Therefore, its behavior is similar to Mo in the LRO domains and, (i) and (ii) can be excluded. Although an Re atom occupies the Mo position in the ordered domains, the Z-contrast images show that the Re atom forms no clusters in the Mo positions. Therefore, Re atoms act as neither a cluster nor ordered domains within the B sites in $A_2B$ to form $Ni_2(Mo_nRe_m)$ for acceleration of the nucleation of the LRO domains. Therefore, no evidence for explanation (iii) can be found in our experimental data.

Close examinations of the HRTEM images demonstrate that most of the SRO and LRO atoms are in the same locations, indicating that LRO occurs in the same location of the SRO. Thus, the Re additions link the SRO and LRO. Z-contrast image shows that the Re atoms stay within the LRO domains close to $Ni_2Mo$-type crystallographic structures. The isolated Re atoms act individually to combine with Ni atoms in acceleration the nucleation of the LRO domains. Therefore, the possible explanations are (iv) and (v) in the preceding paragraph.

Calculations demonstrate that the formation energies for $Ni_2Mo$ and $Ni_2Re$ are −0.127 and −0.141 ev/atom, respectively, making the explanation in scenario (v) more plausible than the rest. This fact indicates that nucleation of $Ni_2Re$ reduces the system energy even at the early state of age hardening. It appears that the Re atoms act as nuclei for early nucleation of the LRO domains by formation of $Ni_2Re$ and then Mo diffuses into the domains to form $Ni_2(Re, Mo)$, thereby accelerating the age-hardening process. accelerated the age hardening process. Thus, it appears that the Re atoms should occupy the Mo positions in the ordered domains in the final products observed by various microscopy technologies.

Further increasing the aging time from 1 to 4 minutes hardens the material by approximately an additional 25% (resulting from the perfection of the LRO). At this time the material almost reaches its maximum hardness without deformation. The domain sizes of the LRO grow up to 10 nm. A slight increase or reduction in aging time does not change the size of the domains significantly. It is quite surprising that the LRO domains rich in both Mo and Re can form in such a short time and have such a significant impact on the hardness of the materials.

Without the Re additions, the LRO domains homogenously nucleate from different locations from the SRO domains and therefore the LRO kinetic is sluggish. Consequently, the prior art alloy requires about 144 minutes to reach the hardness values achieved by the alloy with Re additions in about 4 minutes, as shown in FIG. 2.

The short aging time of the new alloy indicates that the inventive precipitate-hardened alloy can be produced in an energy efficient manner compared with other alloys. The high strength, high modulus, and thermal stability demonstrate that the alloy can substitute various existing Ni-based alloys with superior properties.

After only 4 minutes, the increase in hardness levels out. Thereafter, increasing the aging time to 4 hours at 873 K results in no significant change of the LRO domains compared with those formed when the aging time is only 4 minutes. Even after 529 hours of aging, the hardness shows no sign of decreasing (indicating that over-aging does not occur in this interval). The alloy produced using the present inventive process is thereby seen to be resistant to over-aging.

Therefore, a minimum aging time of under 5 minutes and preferably close to 4 minutes is best in terms of energy efficiency. However, extended aging times of 15 minutes, 50 minutes, or longer can be used without fear of overaging. No significant coarsening of the LRO domains is seen even with very long aging times.

Some users will naturally elect to extend the aging time beyond 4 minutes in order to ensure that near-maximum hardness is achieved, particularly for large components where the temperature in different portions may vary. Using the inventive alloys, this may be safely done without fear of over-aging some portions of the component.

Figure 3:
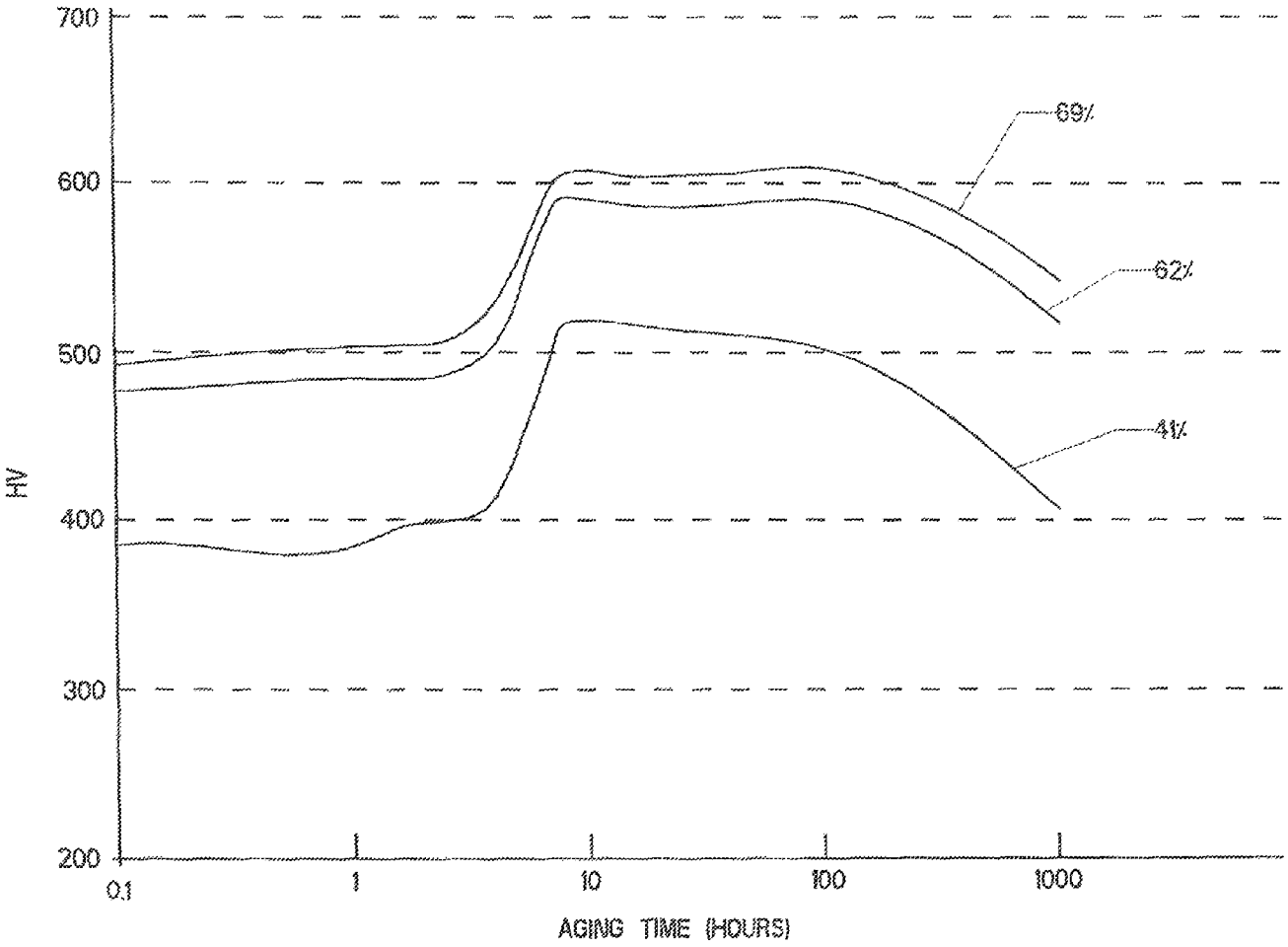
FIG. 3 is a plot of hardness versus aging time for three alloys made according to the present inventive process. The three alloys were deformed to different strain (41%, 62%, and 69%) before the aging.

In practical applications, some users hope that the new alloys can also be processed by existing heat treatment protocol, such as long aging time. This can be achieved by deformation in the invented alloy. Cold work significantly changes the ordering kinetics and consequently the age-hardening behavior of the new nickel-based superalloy. FIG. 3 shows the hardness values of samples which were annealed at 1473 K (1200° C.) for 8 hours, then deformed to 41%, 62%, and 69%. Following the cold work, the samples were aged at 873 K (600° C.) from 36 minutes to over 529 hours. The reader will observe four distinct stages in the precipitation hardening process.

In the first stage (from roughly 36 minutes to 2.4 hours) little age-hardening was observed. Therefore, deformation increases the entropy of the system and makes the SRO partially disappear. In this incubation stage, the age-hardening process operates by nucleation of new LRO domains and requires a longer time in the deformed samples than annealed ones. In the second stage (roughly from 2.4 hours to 4 hours), the hardness values ramp up to 530 HV for 41%, 589 HV for 62%, and 609 HV for 69% deformation strains respectively. A high degree of LRO occurs in this stage. Therefore, the hardening behavior of the cold-worked samples is markedly different from that of the un-worked annealed ones. The hardening is delayed from 4 minutes to about 4 hours at the aging temperature of 873 K (600° C.). This is a remarkable result, as it demonstrates that for this type of alloy cold work decelerates the aging process by a factor of 60, and users can process the alloys as the prior art alloys.

The hardness increases shown in the plots are accompanied by comparable increases in strength, thanks to the presence of the LRO. The ultimate tensile strength and yield strength are respectively 1795 MPa and 1780 MPa for samples worked to 69% strain and then aged to 873 K (600° C.) for 4 hours. The ultimate tensile strength and yield strength for cold worked samples are 1641 MPa and 1500 MPa respectively.

In the third stage of aging, the hardness values reach plateaus when aging times are between 4 hours and 50 hours. In the final stage when samples were aged from 50 hours to 529 hours, samples show a continuing decrease in hardness with increasing time. When the aging time reaches 529 hours, the hardness decreases to levels approximating the levels before aging began. The LRO domains, which have the chemistry of $Ni_2$(Mo, Re) are highly developed. The interfaces between precipitates and the matrix are very sharp. In comparison with samples aged at 873K (600° C.) for 4 hours, not only are the LRO reflections intensified but also the size of the precipitates increased. This relates to the over-aging of the materials. The over-aging is not seen in annealed samples aged up to 529 hours.

Thus, the reader will understand that the formulation of the rhenium containing alloy—with the possible addition of strain hardening—allows a greatly enhanced mechanical strength.

The preceding descriptions contain considerable detail regarding the inventive process. However, these descriptions are properly viewed as defining the preferred embodiments, rather than the scope of the entire invention itself. Thus, the scope of the invention should be fixed by the following claims rather than by the examples given.

The invention claimed is:

1. A method for achieving accelerated age hardening in a metal alloy while minimizing the risk of over-aging, comprising:

a. providing a metal alloy containing nickel, molybdenum, chromium, and rhenium;
b. wherein said rhenium comprises 3% to 10% of the total weight of said metal alloy;
c. wherein said nickel comprises 60% to 70% of the total weight of said metal alloy;
d. wherein said molybdenum comprises 20% to 30% of the total weight of said metal alloy;
e. wherein said chromium comprises 5% to 10% of the total weight of said metal alloy;
f. annealing said metal alloy; and
g. after said annealing step, subjecting said metal alloy to an age hardening process that forms long-range-ordered precipitates of the form $Ni_2Re$.

2. A method for achieving accelerated age hardening in a metal alloy while minimizing the risk of over-aging as recited in claim 1, wherein said age hardening is conducted at a temperature in excess of 800 K.

3. A method, for achieving accelerated age hardening in a metal alloy while minimizing the risk of over-aging as recited in claim 1, wherein said time interval used for said age hardening is less than fifteen minutes.

4. A method for achieving accelerated age hardening in a metal alloy while minimizing the risk of over-aging as recited in claim 3, wherein said time interval used for said age hardening is less than five minutes.

5. A method for achieving accelerated age hardening in a metal alloy while minimizing the risk of over-aging as recited in claim 4, wherein said age hardening is conducted at a temperature of about 873 K.

6. A method for achieving accelerated age hardening in a metal alloy while minimizing the risk of over-aging as recited in claim 3, wherein said age hardening is conducted at a temperature of about 873 K.

7. A method for achieving accelerated age hardening in a metal alloy while minimizing the risk of over-aging as recited in claim 1, wherein said age hardening process is continued for an interval of one minute.

8. A method for achieving accelerated age hardening in a metal alloy while minimizing the risk of over-aging, comprising:

a. providing a metal alloy containing nickel, molybdenum, chromium, and rhenium;
b. wherein said rhenium comprises to 10% of the total weight of said metal alloy;
c. wherein said nickel comprises 60% to 70% of the total weight of said metal alloy;
d. wherein said molybdenum comprises 20% to 30% of the total weight of said metal alloy;
e. wherein said chromium comprises 5% to 10% of the total weight of said metal alloy;
f. annealing said metal alloy at a temperature above 1200 K; and
g. after said annealing step, subjecting said metal alloy to an age hardening process that forms long-range-ordered precipitates of the form $Ni_2Re$ for a time interval of less than fifty minutes at a temperature above 800 K.

9. A method for achieving accelerated age hardening in a metal alloy while minimizing the risk of over-aging as recited in claim 8, wherein said age hardening is conducted at a temperature of about 873 K.

10. A method for achieving accelerated age hardening in a metal alloy while minimizing the risk of oven-aging as recited in claim 9, wherein said time interval used for said age hardening is less than five minutes.

11. A method for achieving accelerated age hardening in a metal alloy while minimizing the risk of over-aging as recited in claim 8, wherein said time interval used for said age hardening is less than five minutes.

* * * * *